US005666590A

United States Patent [19]

Folkins

[11] Patent Number: 5,666,590

[45] Date of Patent: Sep. 9, 1997

[54] DEVELOPER SET UP USING RESIDUAL TONER VOLTAGE READING

[75] Inventor: Jeffrey J. Folkins, Rochester, N.Y.

[73] Assignee: Xerox Corporation, Stamford, Conn.

[21] Appl. No.: 538,660

[22] Filed: Oct. 3, 1995

[51] Int. Cl.[6] ..... G03G 15/00

[52] U.S. Cl. ..... 399/49; 399/50; 399/51; 399/53

[58] Field of Search ..... 355/203, 208, 355/246, 327, 326 R; 399/49, 72, 50, 51, 53

[56] References Cited

U.S. PATENT DOCUMENTS 4,970,536 11/1990 Haneda et al. ..... 355/246 X
5,333,037 7/1994 Inoue et al. ..... 355/203

OTHER PUBLICATIONS

Japanese Patent Application No. 1–340663; H. Matsuo; Publication date Sep. 4, 1994; *Color Image Forming Apparatus.*

*Primary Examiner*—William J. Royer
*Attorney, Agent, or Firm*—John M. Kelly

[57] ABSTRACT

Methods of and apparatus for compensating electrostatic printing process stations for residual toner voltage. A toner patch is produced on a photoreceptor. That toner patch and a section of the untoned photoreceptor are then charged and exposed so as to produce a first latent image. The residual voltage between the exposed toner patch and the exposed section of the untoned photoreceptor is then determined. At least one processing station is then adjusted to compensate for the determined residual toner voltage. Process stations which can be adjusted include development stations, exposure stations and charging stations.

11 Claims, 2 Drawing Sheets

DEVELOPER SET UP USING RESIDUAL TONER VOLTAGE READING

FIELD OF THE INVENTION

The present invention relates to image-on-image electrophotographic printers.

BACKGROUND OF THE INVENTION

Electrophotographic printing is a well known method of producing documents. Electrophotographic printing is typically performed by exposing a substantially uniformly charged photoreceptor with a light image representation of a desired document. In response to that light image the photoreceptor discharges so as to create an electrostatic latent image of the desired document on the photoreceptor's surface. Toner particles are then deposited onto the latent image to form a toner image. That toner image is then transferred from the photoreceptor, either directly or after an intermediate transfer step, onto a substrate such as a sheet of paper. The transferred toner image is then permanently fused to the substrate using heat and/or pressure, thus producing the desired document. The surface of the photoreceptor is then cleaned of residual developing material and recharged in preparation for the creation of another image.

The printing process described above can be modified to produce color images. One color printing process, which is sometimes referred to as the multipass intermediate belt process, develops an image as described above using a first color of toner, transfers the resulting toner layer onto an intermediate belt, develops a second toner layer of a different color, transfers that second toner layer onto the intermediate belt in superimposed registration with the first transferred toner layer, and then repeats the develop-transfer process for third and fourth toner layers of third and fourth colors. After the composite toner image is formed on the intermediate belt the image is transferred and fused onto a substrate. In the multipass intermediate belt process the development of each color of toner layer is essentially independent of the development of the other colors of toner layers. This is beneficial since the developing stations can be set up to produce the desired target toner masses for each color of toner independent of the other developing stations.

Another color electrophotographic printing process, referred to as either image-on-image processing or REaD (Recharge, Expose, and Develop), superimposes toner images of different colors of toner on the photoreceptor prior to the transfer of the composite toner image onto the substrate. While this process is beneficial, it has several drawbacks. For example, when recharging the photo receptor in preparation for creating a color toner image after a previous toner image has been developed it is important to level the voltages between the previously toned and the untoned areas of the photoreceptor. Although it may be possible to achieve voltage uniformity by simply recharging previously toned layers to the same voltage level as neighboring untoned areas, an effect referred to as residual toner voltage complicates the process.

Residual toner voltage is the voltage difference that occurs between toned areas which have been re-exposed and untoned areas which have been exposed. Residual toner voltage reduces the effective development field in the toned areas relative to the untoned exposed areas, thereby hindering the attempt to achieve a uniformly consistent developed mass of the subsequently deposited toner image. The problem becomes increasingly severe as additional toner images are developed. Color quality is threatened since the residual toner voltage can cause color shifts, increased moire effects, increased color shift sensitivity to image registration, and toner spreading at image edges.

Various solutions to the problems caused by residual toner voltage have been proposed. For example, a co-pending U.S. patent application entitled "Method and Apparatus for Reducing Residual Toner Voltage," Ser. No. 08/347,616 discloses a recharging method and apparatus which uses photoreceptors with highly sloped output current (current applied to the charge retentive surface) verses photoreceptor surface voltage characteristics. However, that system's reduction in residual toner voltage is rather limited.

A recharging method which reduces photoreceptor voltage distribution nonuniformities is described in Japanese Patent application No. Hei 1- 340663, Application date Dec. 29, 1989, Publication date Sep. 4, 1991, assigned to Matsushita Denki Sangyo K.K. That reference discloses a color imaging system which uses two rechargers. The first recharger applies a voltage to the photoreceptor which is higher than the voltage the photoreceptor is to have when it passes to an exposure station. The second recharger reduces the surface voltage of the photoreceptor to that which the photoreceptor is to have when it passes to the exposure station. However, patent application No. Hei 1-340663 teaches that the difference in voltage between those applied by the first and second rechargers is sufficient to insure that the polarity of all toner is reversed after passing through the rechargers. The net result is a reduction in the residual charge in the toned areas and a reduction in toner spray. Toner spray is a phenomena that occurs when a photoreceptor carrying a toner image is recharged to a relatively high charge level and then exposed. In areas where the edges of prior developed images align but do not overlap with the edges of a subsequent image, the toner of the prior image tends to spray or spread into the subsequently exposed areas (which have a relatively lower charge level). Reversing the polarity of the toner prevents toner spray since the reversed polarity toner is not attracted to the exposed areas.

While the method described in Japanese Patent application No. Hei 1-340663 is effective in reducing residual toner charge and toner spray, when a composite toner image comprised of a substantial amount of toner is reversed in polarity, a different problem can develop. After recharging and subsequent exposure, the toner in the prior developed toner image has a polarity which is opposite that of both the background untoned areas and the incoming toner which is to form a toner image. An interaction occurs among the three distinctly charged regions. For example, in a system having a negatively charged photoreceptor and which uses discharged area development (DAD), the negatively charged toner used for development would be reversed in polarity after recharge using the teachings of Japanese Patent application No. Hei 1-340663. The positively charged toner layer would then be attracted to the negatively charged background areas and the incoming negatively charged toner. The positively charged toner then tends to splatter onto neighboring bare background regions. This occurrence is called the "under color splatter" defect (UCS). UCS causes unwanted blending of colors and spreading of colors from image edges onto background areas. Furthermore, a relatively large voltage difference between the first and second rechargers would cause a significant amount of stress to be applied to the photoreceptor. That stress could reduce both the image quality and the life expectancy of the developer material.

Co-pending and commonly assigned U.S. patent application,"Split Recharge Method and Apparatus for Color Image Formation," Ser. No. 08/347,617 discloses a recharging method which attempts to solve the UCS problem. Specifically, U.S. patent application Ser. No. 08/347,617 discloses a split recharge configuration wherein a first corona generating device recharges a charge retentive surface having a developed image thereon to a higher absolute potential than a predetermined potential, and then a second corona generating device having an AC voltage supplied thereto recharges the surface to the predetermined potential. The difference in the photoreceptor surface potential after being recharged by the first corona recharge device and the second corona recharge device is called the "voltage split." Significantly, the alternating current from the second recharger substantially neutralizes the electrical charge associated with the image. To prevent the toner in the prior developed toner powder image from reversing polarity the mount of voltage split is limited. This limits the mount of residual toner voltage reduction that can be achieved.

While the above methods are all useful for reducing residual toner voltages they do not completely eliminate the problem. Since image-on-image color electrophotographic processes are sensitive to the effects of residual toner voltages methods of compensating for residual toner voltages would be highly desirable.

SUMMARY OF THE INVENTION

The principles of the present invention provide for electrostatic printing process stations which compensate for residual toner voltages. A method of compensating a processing station for residual toner voltage includes the steps of producing a toner patch on a photoreceptor, charging the toner patch and a section of the untoned photoreceptor, exposing the toner patch and the section of the untoned photoreceptor to form a latent image, measuring the residual toner voltage between the toner patch section of the latent image and the latent image on the untoned photoreceptor, and adjusting at least one process station for the measured residual toner voltage. Beneficially, at least a development station, a charging station, or an exposure station is adjusted.

A printing machine according to the principles of the present invention is comprised of a photoreceptor having a charge retentive surface; a first development station for depositing a first toner patch on the photoreceptor; a charging station for charging photoreceptor and its first toner patch; an exposure station for creating a latent image of a second toner patch over the first toner patch and an untoned section of the photoreceptor; and a correction network, beneficially having a non-contacting voltmeter, which determines a residual toner voltage between an exposed part of the first toner patch and the exposed untoned section of the photoreceptor, the correction network generating a correction signal which is a function of the measured residual toner voltage. Beneficially, the correction signal is used to subsequently adjust a development station, a charging station, and/or an exposure station for the residual toner voltage.

BRIEF DESCRIPTION OF THE DRAWINGS

Other aspects of the present invention will become apparent as the following description proceeds and upon reference to the drawings, in which.

DETAILED DESCRIPTION OF THE PREFERRED EMBODIMENTS

The preferred embodiment of the present invention includes a plurality of individual subsystems which are known in the prior art but which are organized and used so as to produce a composite color image. While the illustrated embodiment is based upon a 5 pass (or 5 cycle) color electrophotographic printing machine, see the printing machine 8 shown in FIG. 1, the present invention is not limited to such embodiments. For example, and without limitation, the principles of the present invention can be used with 4 pass printing machines such as taught in U.S. patent application Ser. No. 08/483,613, filed on 7 Jun. 1995 and entitled, "METHOD AND APPARATUS FOR ESTABLISHING EXPOSURE AND DEVELOPER SET POINTS FOR COLOR IMAGE FORMATION." Therefore, it is to be understood that the present invention is intended to cover all alternatives, modifications and equivalents as may be included within the scope of the appended claims.

Figure 1:
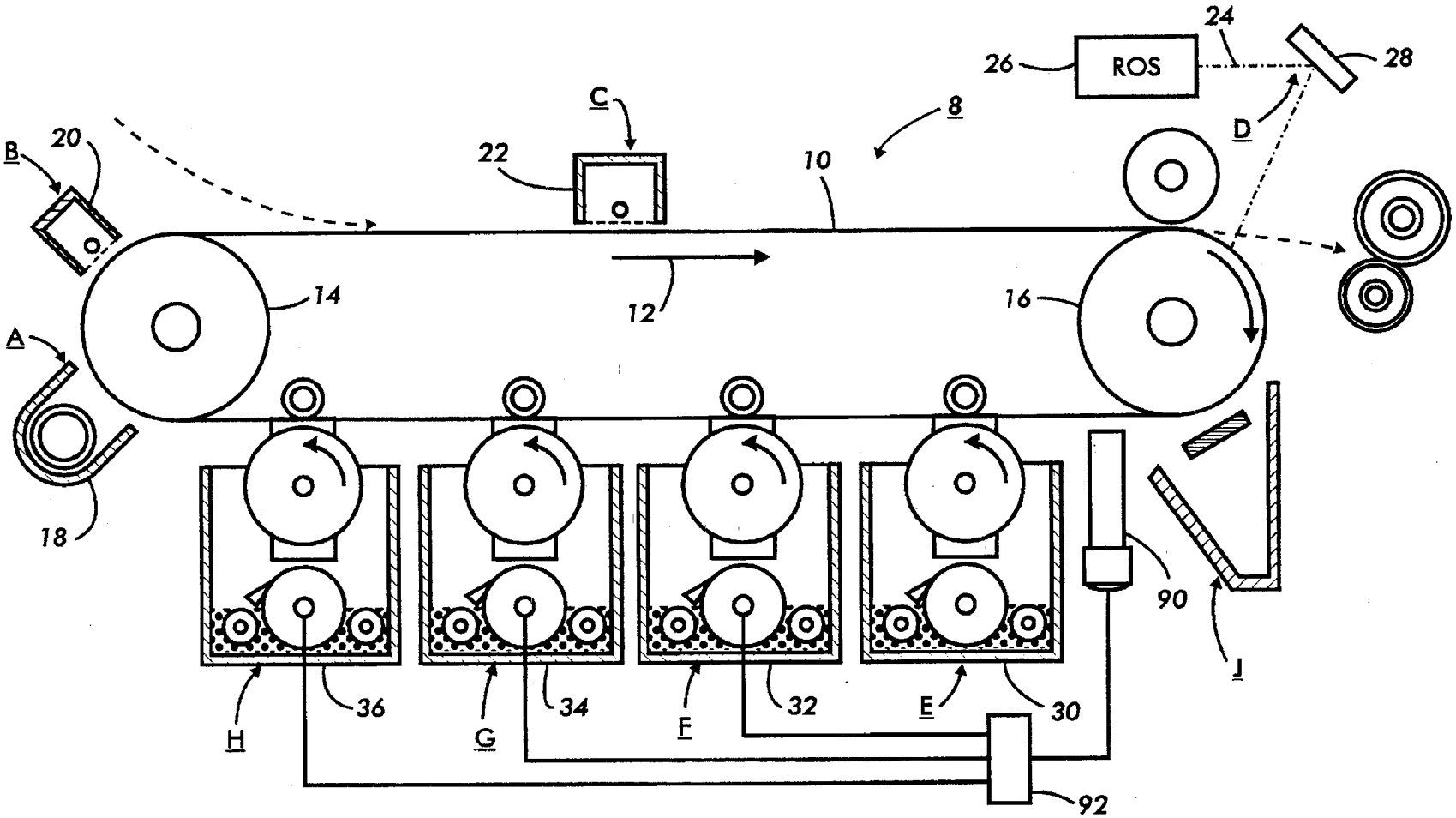
FIG. 1 is a schematic illustration of an electrophotographic printing machine which incorporates the principles of the present invention.

FIG. 1 illustrates a color electrophotographic printing machine 8 which is suitable for implementing the principles of the present invention. While the printing machine 8 is useful for producing color documents as is described in U.S. patent application Ser. No. 08/472,164, entitled "FIVE CYCLE IMAGE ON IMAGE PRINTING ARCHITECTURE," which was filed on 7 Jun. 1995 and which is hereby incorporated by reference, in the following the printing machine 8 is not producing a document but rather is going through a set-up process. That process includes the setting up of one or more processing stations as is subsequently described. Set-up is beneficially performed just after the printing machine 8 is turned on, before the printing machine produces a document. Alternatively, or additionally, set-up can be performed on other occasions, such as after a predetermined number of documents have been produced or upon demand by an operator.

As shown, the printing machine 8 includes an Active Matrix (AMAT) photoreceptor belt 10 which travels in the direction indicated by the arrow 12. Belt travel is brought about by mounting the belt about a tension roller 14 and a drive roller 16 (which is driven by a motor which is not shown).

As the photoreceptor belt travels each part of it passes through each of the subsequently described process stations. For convenience, a single section of the photoreceptor belt, referred to as the image area, is identified. The image area is that part of the photoreceptor belt that is to be exposed and areas immediately around the exposed area.

While the printing machine 8 uses 5 cycles to produce an image, the set-up process described below needs only 4 cycles. The first cycle begins with the image area passing through an erase station A. At erase station A an erase lamp 18 illuminates the image area so as to cause any residual charge which might exist on the image area to be discharged. Such erase lamps and their use in erase stations are well known. Light emitting diodes are commonly used as erase lamps.

As the photoreceptor belt continues its travel the image area passes through a first charging station B. At the first charging station B, a corona generating device 20, beneficially a DC pin scorotron, charges the image area to a relatively high and substantially uniform potential of, for example, about −700 volts. After passing the corona generating device 20 the image area passes through a second charging station C which partially discharges the image area to, for example, about −500 volts. The second charging station C uses an AC scorotron 22 to generate the required ions.

The use of a first charging station to overcharge the image area and a subsequent second charging station to neutralize the overcharge is referred to as split charging. A more complete description of split charging may be found in co-pending and commonly assigned U.S. patent application, "Split Recharge Method and Apparatus For Color Image Formations," Ser. No. 08/347,617 (which is hereby incorporated by reference). Since split charging is beneficial for recharging a photoreceptor which has a developed toner layer, and since the image area does not have such a toner layer during the first cycle, split charging is not required during the first cycle. If split charging is not used in the first cycle either the corona generating device 20 or the scorotron 22 could be used to simply charge the image area to the desired level of −500 volts.

After passing through the second charging station C the now charged image area passes through an exposure station D. At exposure station D the charged image area is exposed by the output 24 of a laser based output scanning device 26 which reflects from a mirror 28. The scanning device discharges some parts of the image area so as to create an electrostatic latent representation of a first toner patch. The exposed part of the image area might be discharged by the output 24 to about −50 volts. Thus after exposure the image area will have a voltage profile comprised of sections at a relatively high voltage of about −500 volts and a section at a relatively low voltage of about −50 volts.

After passing through the exposure station D the exposed image area advances past a first development station E to a second development station F. The first development station E contains a first toner color 30 which is beneficially black. Since the subsequently described colored toner particles are not normally written over black toner, a residual toner voltage is not formed over black toner. Thus compensating for residual toner voltage on black toner is not required.

While the first development station could be a magnetic brush developer, a scavengeless developer may be somewhat better. Scavengeless development is well known and is described in U.S. Pat. No. 4,984,019 entitled, "Electrode Wire Cleaning," issued 3 Jan. 1991 to Folkins; in U.S. Pat. No. 4,868,600 entitled "Scavengeless Development Apparatus for Use in Highlight Color Imaging," issued 19 Sep. 1989 to Hayes et al.; in U.S. Pat. No. 5,010,367 entitled "Dual AC Development System for Controlling The Spacing of a Toner Cloud," issued 23 Apr. 1991 to Hays; in U.S. Pat. No. 5,253,016 entitled, "Contaminant Control for Scavengeless Development in a Xerographic Apparatus," issued on 12 Oct. 1993 to Behe et al.; and in U.S. Pat. No. 5,341,197 entitled, "Proper Charging of Doner Roll in Hybrid Development," issued to Folkins et al. on 23 Aug. 1994. Those patents are hereby incorporated by reference.

One benefit of scavengeless development is that it does not disturb previously deposited toner layers. Since during the first set-up cycle the image area does not have a previously developed toner layer, the use of scavengeless development is not absolutely required as long as the developer is physically cammed away during other cycles. However, since the other development station (described below) use scavengeless development it may be better to use scavengeless development at each development station.

However, the second development station F deposits a second color of negatively charged toner 32, beneficially yellow, onto the latent image to form a first toner patch. Since the toner 32 is charged to a negative voltage of about −200, after development the photoreceptor belt 10 has a section charged to about −200 volts (the developed image area) and a section charged to about −500 volts.

After passing through the second development station F, the image area returns to the first charging station B. The second set-up cycle then begins. The first charging station B uses its corona generating device 20 to overcharge the image area and its first toner patch to more negative voltage levels than that which they are to have when they are next exposed. For example, the image area and its first toner patch may be charged to a potential of about −700 volts.

At the second charging station C the AC scorotron 22 reduces the negative charge on the image area by applying positive ions to the image area. After the image area passes the second charging station both the first toner patch and the untoned part of the image area have a potential of about −500 volts. While this split recharging is effective in reducing the residual toner voltage which develops after the second exposure described below, it does not fully eliminate it.

An advantage of using an AC scorotron at the second charging station is that it has a high operating slope: a small voltage variation on the image area can result in large charging currents being applied to the image area. Beneficially, the voltage applied to the metallic grid of the AC scorotron 22 can be used to control the voltage at which charging currents are supplied to the image area. A disadvantage of using an AC scorotron is that it, like most other AC operated charging devices, tends to generate more ozone than comparable DC operated charging devices.

After passing through the second charging station C the now substantially uniformly charged image area with its developed first toner patch advances to the exposure station D. At the exposure station D the recharged image area is again exposed to the output 24 of a laser based output scanning device 26. During this cycle the scanning device 26 illuminates the image area to produce a second latent toner patch which is somewhat larger than the first toner patch, but which is over the first toner patch. In general, the illumination energy used to produce the second latent toner patch should be of a high enought intensity such that the voltage level difference between the toned and the untonded areas are not substantially dominated by the differential light absorbtion effect caused by having to expose through the toned layer.

Figure 2:
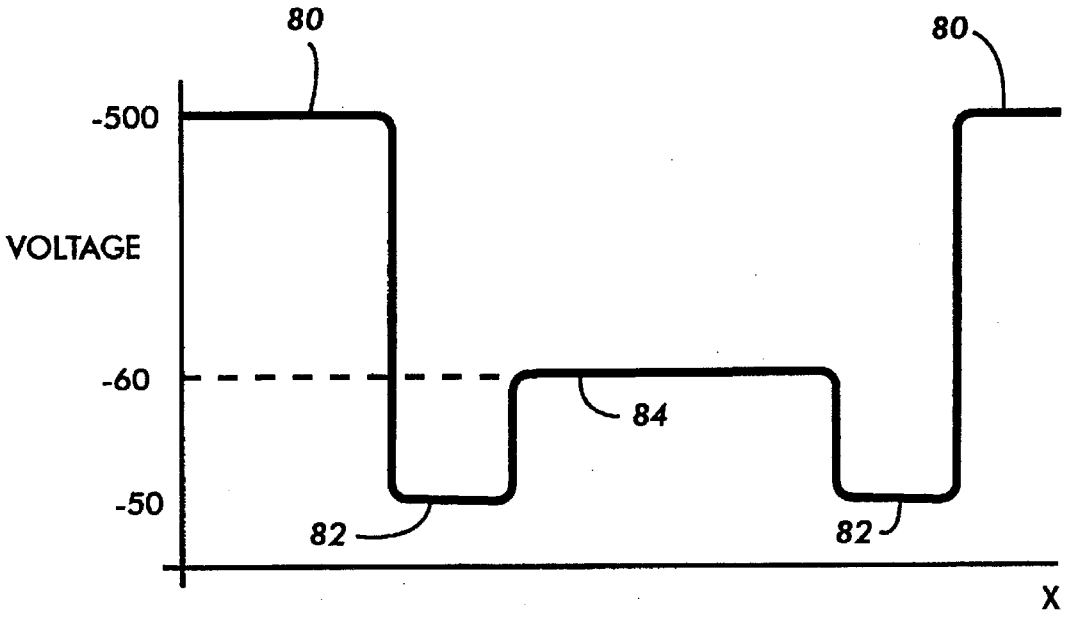
FIG. 2 shows a voltage profile of a cross-section of an image area in the electrophotographic printing machines illustrated in FIGS. 1 after that image area has been developed, recharged, and re-exposed.

FIG. 2 shows an example of a voltage profile which might exist on a cross section of the image area after it has been exposed for the second time. So that important features of the voltage profile are readily apparent FIG. 2 is not drawn to scale. Sections 80 of the image which have not been illuminated, either in the first pass through the exposure station D or in the second, have a potential about −500. Sections 82 of the second latent toner patch, exposed areas of the second latent toner patch which are not over the first toner patch, are discharged to a potential of about −50 volts. Thus the sections 80 and 82 are similar to potentials which existed following the first pass through the exposure station D. However, sections 84, which are exposed sections of the first toner patch, have a potential of, say −60 volts. The potential difference between the sections 82, and 84 represents the residual voltage. Thus, the residual voltage illustrated by FIG. 2 is −10 volts (−60 minus −50). It should be understood that the actual residual voltage is very difficult (or impossible) to accurately predict. Measurement is probably required.

Referring once again to FIG. 1, after passing through the exposure station D the image area passes by a non-contacting electrostatic voltmeter 90. That voltmeter measures the residual voltage on the second latent patch and outputs the measured residual voltage to a controller/selector 92. The controller/selector selects which of the development stations, the Development stations G or H, which will be used for developing the next latent patch. During the second set-up cycle the controller/selector 92 selects the development station G. In response to the measured residual toner voltage the controller/selector outputs a correction signal or correction signals which can be used by the development station G, the development station H, the charging station B (alternatively the charging station C), and/or by the exposure station D to compensate for processing differences caused by the residual voltage.

In a preferred embodiment the correction signal is a DC voltage which changes the developed toner mass set-up of the selected development station (in the second pass, the development station G). That correction signal is beneficially derived from either a formula or from a stored table which relates residual toner voltages to deviations in deposited toner mass for the development station. Initially, each development station is set up to produce a desired toner mass for a nominal amount of residual toner voltage. Then, the set-up for the selected development station is adjusted according to the correction signal so that the developed toner mass is at the desired level despite the presence or change in the amount of a residual toner voltage. Without compensation the developed mass will be a function of the residual toner voltage.

Alternatively, the correction signal could be a voltage, current, or a digital signal which changes the intensity of light from the exposure station D and/or the charging level of the charging station B (or C). For example, each development station could be set up to produce the desired toner mass in the presence of a specific residual toner voltage. Then, the set-up for the exposure station and/or the charging station could be adjusted according to the correction signal so that the specific residual toner voltage is produced. It is also possible to adjust a development station together with the exposure station and/or the charging station in response to the correction signal. Therefore, while the illustrated embodiment is described as using the correction signal to adjust the toner mass from the development stations G and H, it is to be understood that in other embodiments that the correction signal (or signals) could be used to adjust other processing stations. Still referring to FIG. 1, after passing the voltmeter 90 the image area advances to the third development station G. The third development station deposits a third color of toner 34, say magenta, onto the image area so as to form a second toner patch over at least part of the first toner patch. As discussed above, the deposited toner mass from the third development station G, which forms the second toner patch, is adjusted by the correction signal to compensate for any residual toner voltage which may exist on the first toner patch. The controller/selector stores the correction signal so that after completion of the set-up process that the same correction signal can be applied to the development station G.

After passing through fie third development station G the image area and its two toner patch layers return to the first charging station B. The third set-up cycle then begins. The first charging station B again uses its corona generating device 20 to overcharge the image area and the two toner patch layers to more negative voltage levels than that which the image area and the two patches layers are to have when they are exposed. The second charging station C again reduces the image area potentials to about −500 volts. The charged image area then advances to the exposure station D. At exposure station D the image area is again exposed to the output 24 of the laser based output scanning device 26. During this cycle the scanning device 26 exposes the image area so as to create a third latent toner patch, which is somewhat larger than the second toner patch, but which is formed over at least part of the second toner patch.

After passing through the exposure station D image area again passes the voltmeter 90. This time the voltmeter measurement is used by the controller/selector 92 to determine a correction signal for the fourth development station H. The fourth development station H is used in normal operation to advance a fourth color of toner 36, say cyan, onto the photoreceptor belt 10. However, during the set-up process the fourth development station (which is already compensated by the controller/selector 92) need not be develop the latent image. Again, the controller/selector 92 stores the correction signal so that after completion of the set-up process that the same correction signal can be applied to the development station H.

After passing through development station H the fourth set-up cycle begins. The image area is advanced to cleaning station J which cleans the developed toner patches from the photoreceptor belt 10. Set up is then complete and normal operation of the printing machine 8 can then resume.

The various machine functions described above are generally managed and regulated by a separate controller which provides electrical command signals for controlling the operations described above.

It is to be understood that while the figures and the above description illustrate the present invention, they are exemplary only. Others who are skilled in the applicable arts will recognize numerous modifications and adaptations of the illustrated embodiments which will remain within the principles of the present invention. Therefore, the present invention is to be limited only by the appended claims.

What is claimed:

1. A printing machine, comprising:

a photoreceptor;

a first development station for depositing a first toner patch on said photoreceptor;

a charging station for charging the first toner patch and a first untoned section of said photoreceptor:

an exposure station for creating a latent image of a second toner patch on said first toner patch and on said first untoned section of said photoreceptor; and a correction network for producing a correction signal which is a function of a residual toner voltage between said second toner patch latent image on said first toner patch and said second toner patch latent image on said first untoned section of said photoreceptor.

2. The printing machine according to claim 1, further including a second development station which operatively receives said correction signal and which develops a second toner patch on said second toner patch latent image as a function of said correction signal.

3. The printing machine according to claim 1, further including a charging station which operatively receives said correction signal and which adjusts the flow of ions from said charging station in response to said correction signal.

4. The printing machine according to claim 1, further including an exposure station which operatively receives said correction signal and which adjusts the exposure of said photoreceptor in response to said correction signal.

5. The printing machine according to claim 1 wherein said correction network includes a voltmeter.

6. The printing machine according to claim 5 wherein said voltmeter is a non-contacting electrostatic voltmeter.

7. The printing machine according to claim 5, further including a second development station which operatively receives said correction signal and which develops a second toner patch on said second toner patch latent image as a function of said correction signal.

8. The printing machine according to claim 5, further including a charging station which operatively receives said correction signal and which adjusts the flow of ions from said charging station in response to said correction signal.

9. The printing machine according to claim 5, further including an exposure station which operatively receives said correction signal and which adjusts the exposure of said photoreceptor in response to said correction signal.

10. The printing machine according to claim 5 wherein said charging station uses split charging.

11. A method of compensating a printing machine for residual toner voltage, the method comprises the steps of producing a toner patch on a photoreceptor, charging the toner patch and an untoned section of the photoreceptor, exposing the toner patch and the untoned section of the photoreceptor, measuring the residual toner voltage between the toner patch and the untoned section of the photoreceptor, and compensating a process station for the measured residual toner voltage.

* * * * *